US006514098B2

(12) United States Patent
Marpoe, Jr. et al.

(10) Patent No.: US 6,514,098 B2
(45) Date of Patent: Feb. 4, 2003

(54) ELECTRICAL CONNECTOR WITH TERMINAL AND CONNECTOR POSITION ASSURANCE DEVICES

(75) Inventors: Gary Ray Marpoe, Jr., Kernsville, NC (US); Kenneth Wade Long, Jr., Kill Devil Hills, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/752,789

(22) Filed: Dec. 28, 2000

(65) Prior Publication Data

US 2002/0086575 A1 Jul. 4, 2002

(51) Int. Cl.[7] ..... H01R 13/627
(52) U.S. Cl. ..... 439/352; 439/701
(58) Field of Search ..... 439/352–357, 439/701, 752

(56) References Cited

U.S. PATENT DOCUMENTS

| | | | | |
|---|---|---|---|---|
| 4,634,204 A | | 1/1987 | Detter et al. | |
| 5,120,255 A | | 6/1992 | Kouda et al. | |
| 5,507,666 A | | 4/1996 | Yamanshi | |
| 5,562,486 A | | 10/1996 | Saijo et al. | |
| 5,591,041 A | | 1/1997 | Cecil, Jr. et al. | |
| 5,605,472 A | | 2/1997 | Sakai et al. | |
| 5,628,648 A | | 5/1997 | Higgins, Jr. et al. | |
| 5,628,649 A | | 5/1997 | Yagi et al. | |
| 5,643,003 A | | 7/1997 | Raudenbush | 439/352 |
| 5,651,689 A | | 7/1997 | Flyer et al. | 439/352 |
| 5,722,849 A | | 3/1998 | Alwine | |
| 5,820,387 A | | 10/1998 | Borisch et al. | |
| 5,823,814 A | | 10/1998 | Alwine | |
| 5,910,027 A | | 6/1999 | Wayt et al. | |
| 6,004,153 A | | 12/1999 | Myer et al. | 439/352 |
| 6,045,388 A | | 4/2000 | Higgins et al. | |
| 6,059,597 A | * | 5/2000 | Endo et al. | 439/352 |
| 6,093,045 A | | 7/2000 | Hoff | |
| 6,109,955 A | * | 8/2000 | Hanazaki et al. | 439/489 |
| 6,241,547 B1 | * | 6/2001 | Fukuda | 439/352 |
| 6,261,115 B1 | * | 7/2001 | Pederson et al. | 439/352 |

OTHER PUBLICATIONS

U.S. patent application Ser. No. 09/780,296, Raudenbush et al., filed Feb. 9, 2001.
U.S. patent application Ser. No. 09/785,369, Myer et al., filed Feb. 16, 2001.

* cited by examiner

*Primary Examiner*—Khiem Nguyen

(57) ABSTRACT

An electrical connector housing assembly is provided having a plug assembly and cap assembly matable with one another to form a wire to wire, wire to board or wire to device connection. The plug assembly is formed with a latching member thereon, while the cap assembly is formed with a connector position assurance device (CPA) thereon. The overall envelope of the connector housing assembly is reduced by dividing the latch member and CPA between the plug and cap housings. Keying features are formed integrally with plug and cap terminal position assurance devices (TPAs) to ensure proper orientation between the plug and cap and to further assure that each plug is connected to the corresponding cap. The overall envelope is further reduced by forming the keying features internal to the housings upon the TPAs.

26 Claims, 12 Drawing Sheets

ELECTRICAL CONNECTOR WITH TERMINAL AND CONNECTOR POSITION ASSURANCE DEVICES

BACKGROUND OF THE INVENTION

The preferred embodiments of the present invention generally relate to electrical connectors with one or more terminal and connector position assurance features. More particularly, a connector position assurance device (CPA) is provided affording a low vertical profile and a terminal position assurance device (TPA) is provided including integral keying features.

A CPA functions to assure an operator that the matable connector halves have been mated which is particularly advantageous on an assembly line where the operator must make connections quickly and be certain that electrical connections are, in fact, mated. It is desirable that the CPA be compact in size and eliminate the risk of inadvertent separation of the connector halves by separately preventing deflection of any latches used to maintain the mated condition.

In many applications, several connectors (including plugs and associated headers) may be routed to a common area, such as on a vehicle. All of the connectors are connected when the vehicle reaches a designated point along an assembly line. In certain instances, a need has arisen for assembly line personnel to be able to distinguish between connectors to ensure that each plug is inserted into an associated and correct header. In the past, assembly line personnel have experienced difficulties in discriminating each plug and the associated header from other plugs and headers.

Many conventional connector configurations have been proposed, such as for plug-header assemblies for wire-to-wire connections, plug-header assemblies for wire-to-printed circuit board connections (such as in board applications), and plug-device assemblies (such as sensors and the like). Hereafter the terms plug and cap shall be used to refer generically to any and all connector applications, including, but not limited to, wire to wire, PCB to wire, plug to device, and the like. Some conventional connectors include connector position assurance systems, such as described in U.S. Pat. No. 6,004,153; and U.S. Pat. No. 5,643,003. The '003 patent and the '153 patent, as in conventional CPA systems, include a plug housing with a latch formed thereon. The latch slidably receives a CPA which is mounted to the plug housing and is operable to assure that a further matable connection is fully mated to the housing before the CPA may be moved to its engaged position.

However, conventional CPA and latch assemblies require a CPA carriage structure formed on top of the latch assembly, or visa versa. Typically, latches are formed to be moved toward and away from the plug housing, and thus the CPA is mounted above or below the latch to block such vertical motion. Stacking the CPA and latch upon one another unduly increases the overall envelope of the connector. With increasing demands being placed on miniaturization of connectors, a need exists to continue to further reduce the outer envelope of the connector device.

In assembly line applications, it is desirable to facilitate the visual inspection by an assembly line person of a plurality of connector devices. Conventional CPA shrouds are configured to direct the CPA inward into the CPA shroud assembly whereby the CPA shroud hides a substantial majority of the CPA structure. Consequently, during an assembly line application, it is difficult to visually determine whether a CPA has been fully engaged, and thus it is difficult to visually determine whether a plug and cap are properly fully mated.

In addition, in assembly line applications, it is desirable to ensure that the assembly line person insert the plug and cap housings in proper orientation with respect to one another. Conventional connectors have been proposed with keying features that ensure proper orientation between the plug and cap housings before permitting full mating engagement therebetween. However, such conventional keying features are provided on the plug and cap housings, thereby increasing the overall envelope of the connector device. A need exists to reduce the envelope of the connector device while ensuring that the plug and cap housings may be fully mated only when properly aligned.

Conventional connectors have been proposed that include terminal position assurance devices (TPA) which are received within the plug housing and engaged to the connector contacts. TPAs ensure that connector wires are properly and fully mated within a plug housing before permitting the TPA from being moved to an engaged position. In the past, TPAs (also referred to as wedges) when provided to a manufacturer of a connector device are delivered entirely separate from the plug and cap housings. The TPAs (or wedges) are inserted into the plug and cap housings immediately before insertion of the contacts and wires. A need exists for an improved TPA that may be assembled with a plug and cap housing separate and apart from insertion of the contacts and wires.

A need remains for improved CPA and TPA features for connector assemblies that overcome the problems discussed above. The preferred embodiments of the present invention described below address the above discussed needs and other disadvantages of conventional connector devices that will become readily apparent from the following description, drawings and claims.

BRIEF SUMMARY OF THE INVENTION

An electrical connector housing assembly is provided that includes a connector position assurance device (CPA) having a reduced overall envelope. The housing assembly includes a plug housing and a cap housing, each of which have top, bottom and side walls defining a mating interface therebetween. One of the plug and cap housings are formed with a deflectable latch formed thereon, while the other of the plug and cap housings are formed with a CPA carriage or retainer. A CPA is retained within the CPA carriage structure and is moveable relative to the carriage structure between an initial disengaged position and a final engaged position indicating that the plug and cap housings have been properly mated with one another.

In accordance with at least one alternative embodiment, an electrical connector housing assembly is provided having plug and cap housings with top, bottom and side walls defining a mating interface therebetween. The plug and cap housings each receive terminal position assurance devices (TPAs). Plug and cap TPAs are formed integrally with keying features, such as a keying post and keying opening that ensure proper orientation between the plug and cap assemblies before permitting mating. The keying features on the plug and cap TPAs may be varied between plugs and caps in a single application to uniquely identify which cap is to be associated with each plug. By including keying features on the TPAs, the overall envelope of the connector housing assembly is reduced while offering the advantages of a keying configuration.

In at least one alternative embodiment, the CPA retaining structure includes a pair of guide rails aligned parallel to one another and mounted on a top wall of the cap housing. The guide rails include juxtaposed channels cut therein and defining a guide way that slidably receives flanges along opposite sides of a CPA. The CPA is moveable within the guide way between an initial position at which the CPA is substantially enclosed within the guide rails and a final engaged position at which the CPA partially projects from the guide rails to facilitate visual inspection of the CPA's present state. The plug and cap assemblies may be mated with one another even when the CPA is initially, prematurely placed in its final position since the CPA is permitted to be deflected slightly in the guide ways under a biasing force outward away from the cap housing as the latch member is moved to its engaged position.

BRIEF DESCRIPTION OF THE DRAWINGS

The foregoing summary, as well as the following detailed description of the preferred embodiments of the present invention, will be better understood when read in conjunction with the appended drawings. For the purpose of illustrating the invention, there are shown in the drawings, embodiments which are present preferred. It should be understood, however, that the present invention is not limited to the precise arrangements and instrumentality shown in the attached drawings.

DETAILED DESCRIPTION OF THE INVENTION

Figure 1:
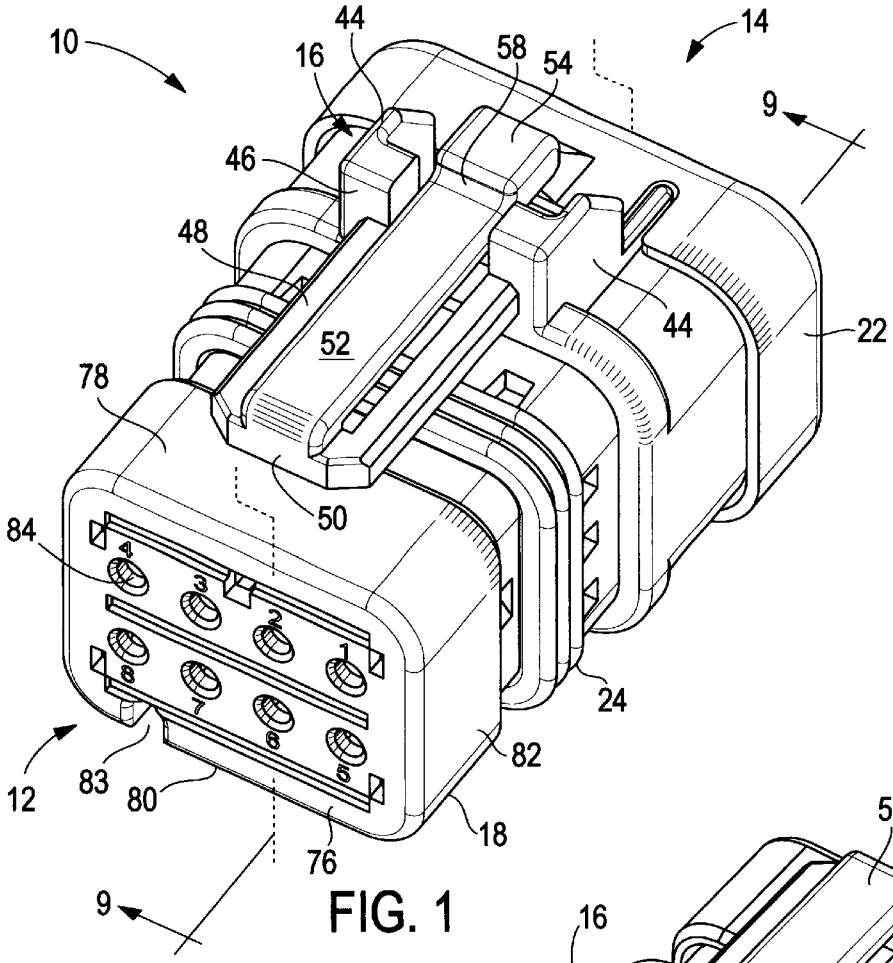
FIG. 1 illustrates an isometric view from a mating end of a plug assembly in accordance with a preferred embodiment of the present invention.
Figure 3:
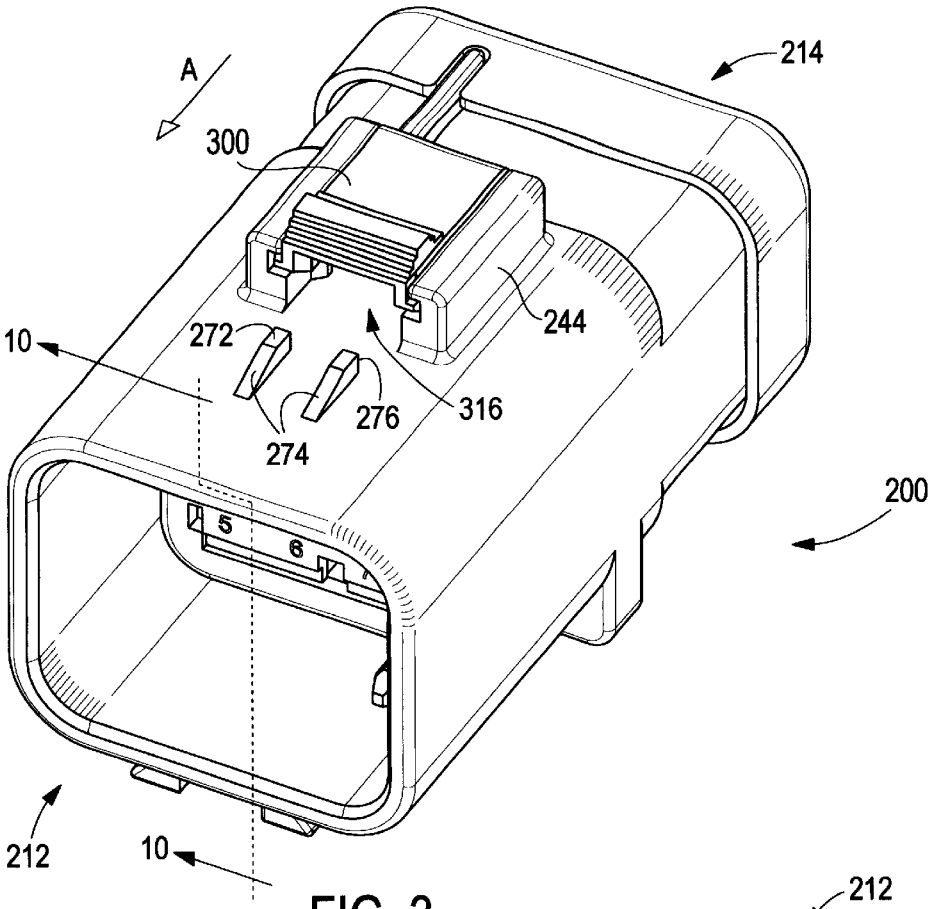
FIG. 3 illustrates an isometric view from a mating end of the cap assembly in accordance with a preferred embodiment of the present invention.

FIG. 1 illustrates a plug assembly 10 having a front end 12 and rear end 14. The front end 12 mates with a cap assembly 200 (FIG. 3). The plug assembly 10 includes a latching member 16 formed on one side thereof. The latching member 16 may be formed on the top, bottom or either side wall of the plug assembly 10. Optionally, more than one latching member 16 may be provided and may be arranged side by side, on opposed walls and the like. The latch member 16 may be formed integrally with the plug assembly 10. Alternatively, the latch member 16 may be mounted to the plug assembly 10 as a separate unitary structure affixed to the plug assembly 10 in any of several manners, such as through adhesive, glue, snaps, screws and other fastening means. The front end 12 of the plug assembly 10 includes a plug terminal position assurance device (TPA) 18 firmly affixed thereto.

Figure 2:
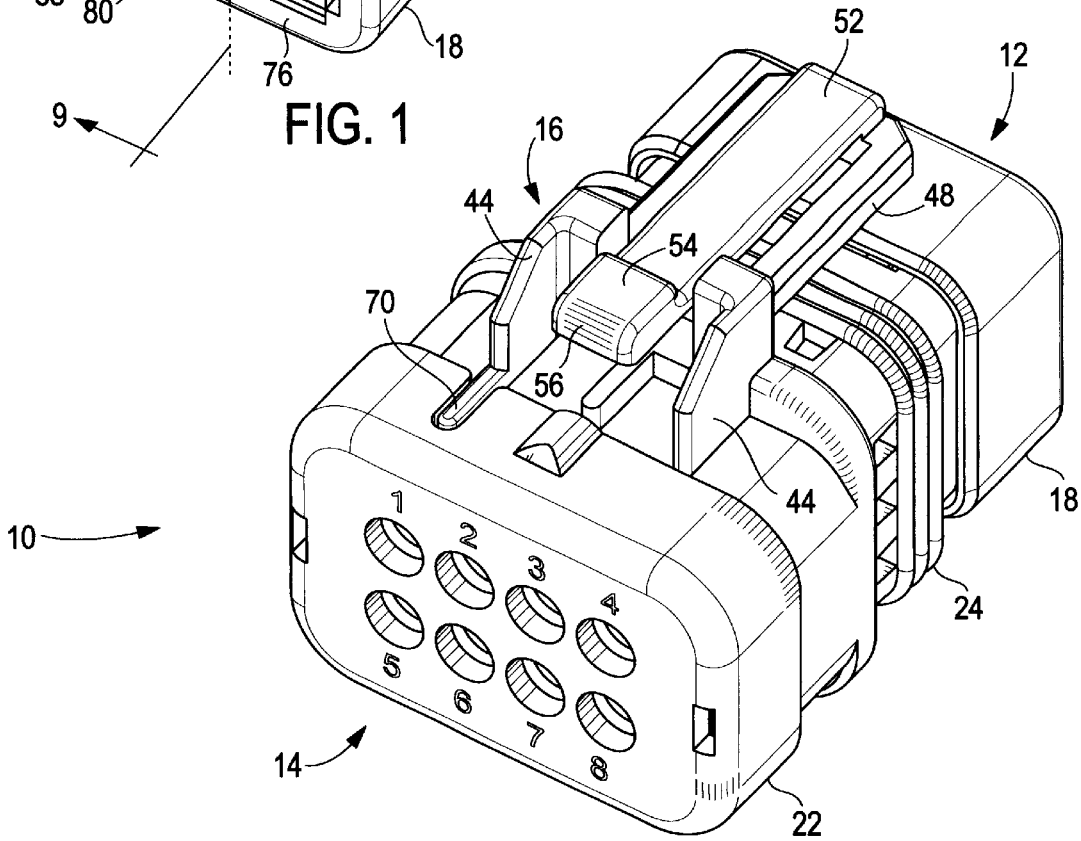
FIG. 2 illustrates an isometric view from a back end of the plug assembly in accordance with a preferred embodiment of the present invention.

FIG. 2 illustrates the plug assembly 10 from the opposite direction, namely with the rear end 14 in full view. The rear end 14 of the plug assembly 10 includes a plug cover seal 22.

Figure 5:
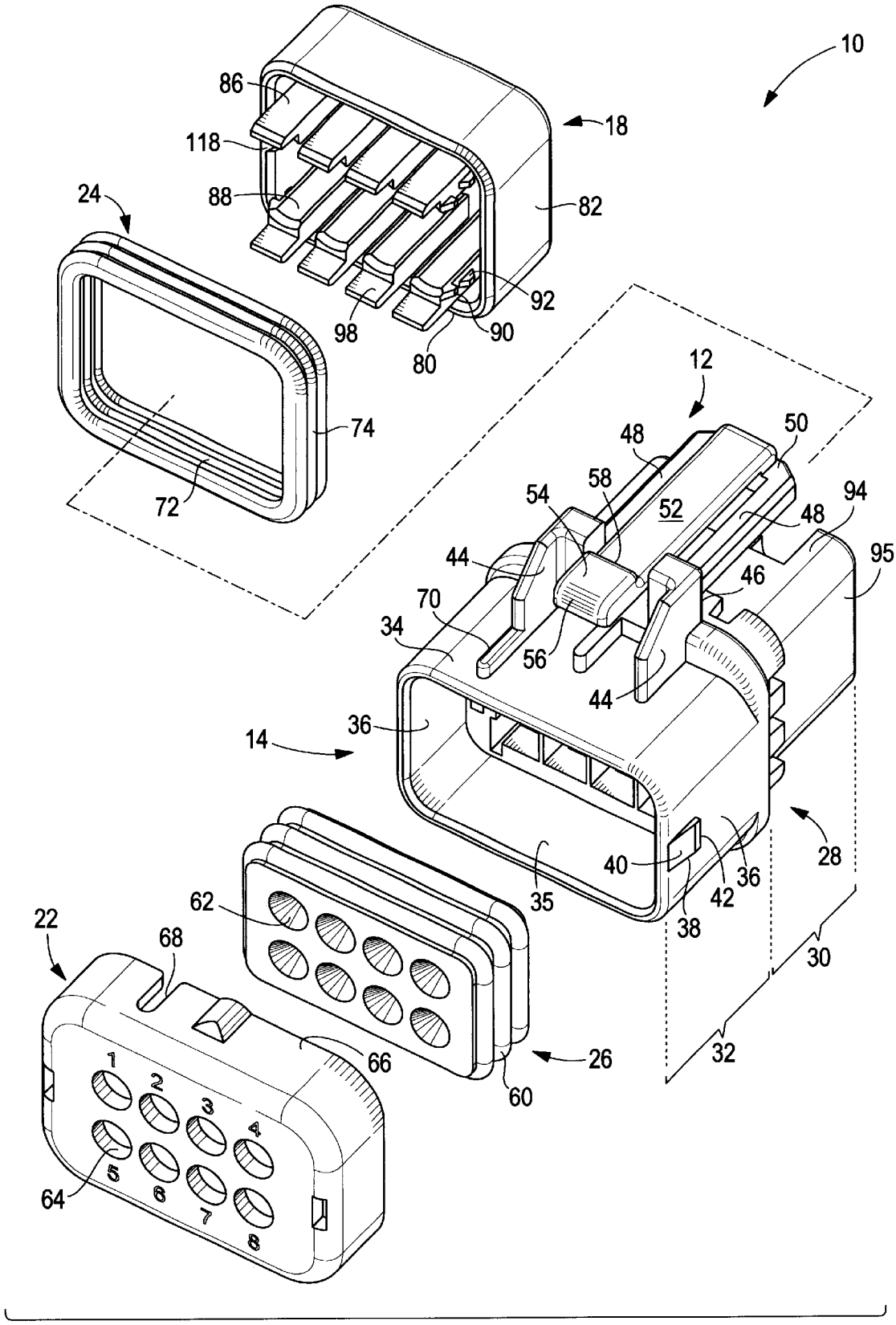
FIG. 5 illustrates an exploded isometric view from the back end of the plug assembly in accordance with a preferred embodiment of the present invention.

FIG. 5 illustrates an exploded view of the plug assembly 10. The plug assembly 10 is comprised of several components including the plug TPA 18, a peripheral seal 24, a plug wire seal 26 and the plug seal cover 22. The plug assembly 10 further includes a plug housing 28 formed with front and rear sections 30 and 32.

The plug rear section 32 includes rear top, bottom and side walls 34–36 that cooperate to define a cavity configured to accept the plug wire seal 26. The plug cover seal 22 is snapplingly received over the outer edges of the rear top, bottom and side walls 34–36. Latching projections 38 are formed on at least one of the rear top, bottom and side walls 34–36 to snappably secure the plug cover seal 22 to the plug housing 28. The latching projection 38 includes a ramped surface 40 over which a notch cut in an interior surface of the wall of the plug cover seal 22 travels. A rear side of the latching projections 38 include engaging shoulders 42 that securely contact similarly shaped notches in the interior walls of the plug cover seal 22 in order to retain the plug cover seal 22 in an engaged position.

As shown in FIGS. 1 and 2, vertical supports 44 are mounted on at least one wall of the plug housing 28. The vertical supports 44 extend upward from the plug housing 28 in a parallel manner. Rear surfaces 46 of the vertical supports include support rods 48 formed therewith and extending in a direction substantially parallel to a longitudinal axis of the plug housing 28. The support rods 48 are joined at an outer end by a cross bar 50. An intermediate portion of the cross bar 50 is formed integrally with a latch beam 52 that also extends in a direction substantially parallel to the longitudinal axis of the plug housing and is located between the support rods 48. The support rods 48 extend from the vertical supports 44 in a direction toward the front end 12 of the plug assembly 10, while the latch beam 52 extends from the cross bar 50 in an opposite direction toward the rear end 14. The rear tip of the latch beam 52 includes a decoupling post 54 projecting upward therefrom. The decoupling post 54 includes a chamfered surface 56 and a top surface 58.

The plug wire seal 26 (FIG. 5) includes outer rib surfaces 60 sealing the interface between the interior surfaces of the rear top, bottom and side walls 34–35 of the housing 28 and the plug cover seal 22. The plug wire seal 26 further includes an array of wire receiving apertures 62 for receiving wires (not shown). The plug cover seal 22 further includes wire receiving openings 64 aligning with the wire receiving apertures 62 in the plug wire seal 26. A top side 66 of the plug cover seal 22 includes a slot 68 directed toward and configured to align with a rib 70 formed on the top wall 34 of the plug rear section 32. The rib 70 and slot 68 cooperate to ensure proper orientation and alignment of the plug cover seal 22 when mounted on the plug rear section 32.

The peripheral seal 24 includes inner and outer rib surfaces 72 and 74 forming a sealed connection between an outer peripheral surface of the plug front section 30 and an interior surface of the plug TPA 18. The peripheral seal 24 is received over the plug front section 30 and is enclosed within the plug TPA 18 when the plug TPA 18 is mounted to the plug housing 28. The plug TPA 18 includes an outer face plate 76 and top, bottom and side walls 78, 80 and 82 (FIG. 1). The face plate 76 includes a plurality of wire receiving openings 84 formed in a desired array corresponding to the configuration of wire receiving apertures 62 and wire receiving openings 64.

Figure 12:
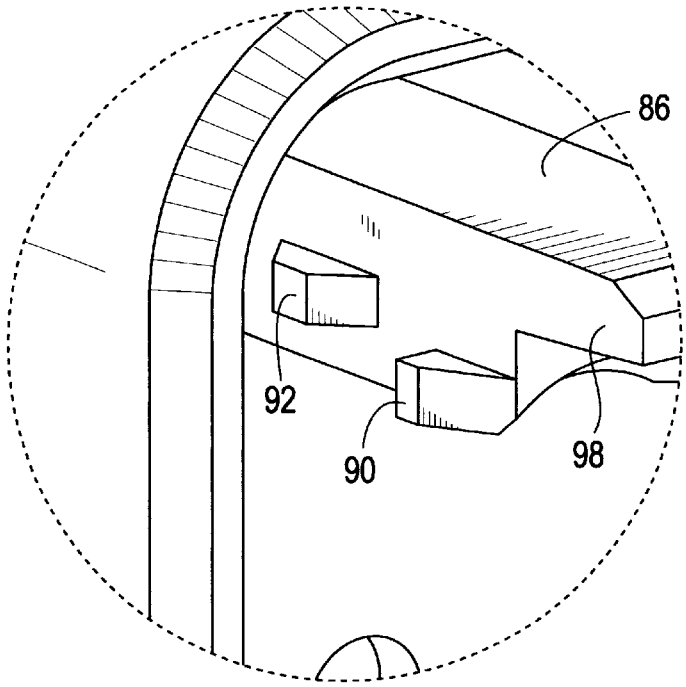
FIG. 12 illustrates an enlarged portion of the plug TPA of FIG. 11.
Figure 11:
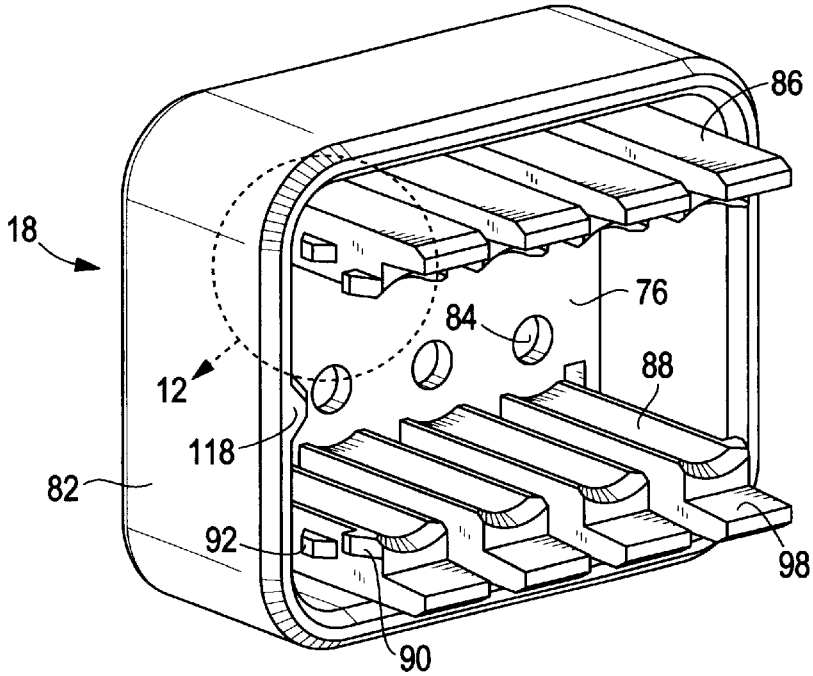
FIG. 11 illustrates an isometric view of a plug terminal position assurance device in accordance with a preferred embodiment of the present invention.
Figure 14:
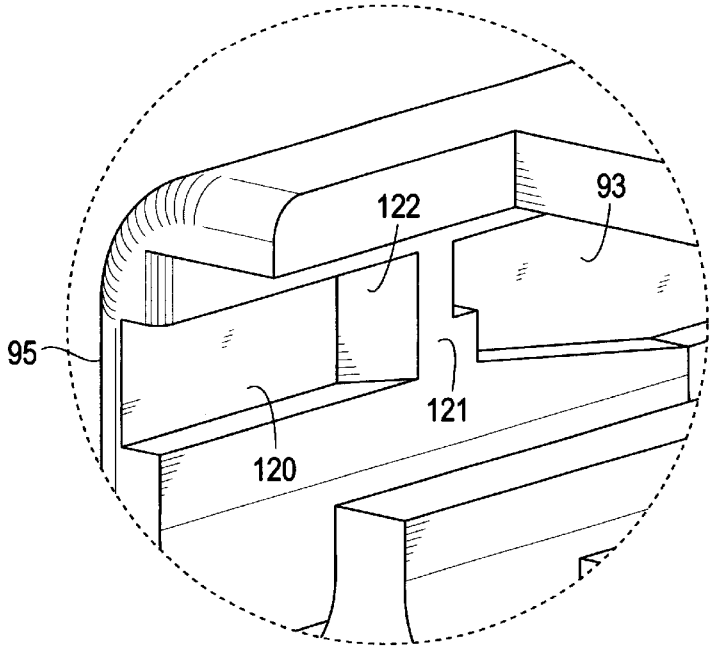
FIG. 14 illustrates an enlarged view of a portion of the plug housing of FIG. 13.
Figure 13:
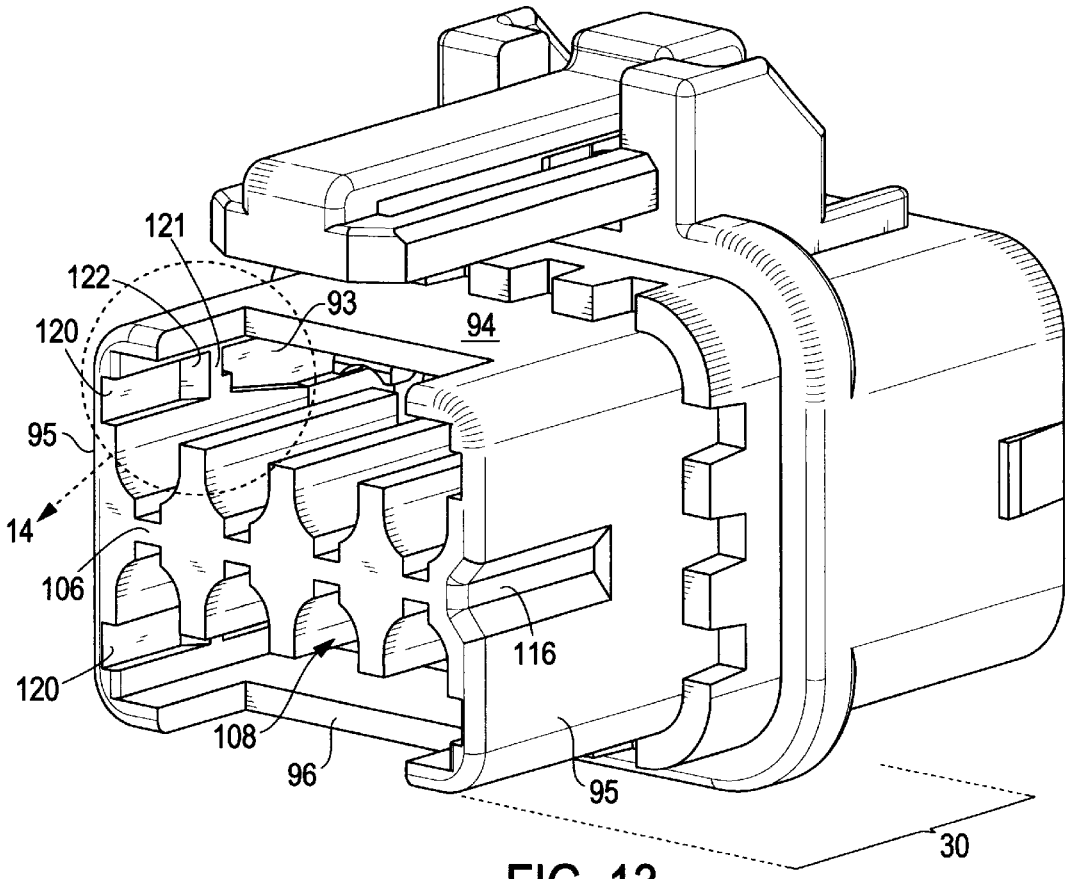
FIG. 13 illustrates an isometric view of a plug housing formed in accordance with a preferred embodiment of the present invention.

As shown in FIGS. 5 and 11, the interior surface of the face plate 76 is formed with a plurality of TPA arms 86 mounted thereon and aligned with associated wire receiving openings 84. Each TPA arm 86 includes an inner wire guide surface 88 formed with an arcuate shape to define a trough extending in a direction substantially parallel to the longitudinal axis of the plug housing 28. The TPA arms 86 are located along the outer periphery of the wire receiving openings 84. At least one TPA arm 86 includes a stop wedge 90 and a locking wedge 92 formed along an outer side of the TPA arm 86 (FIGS. 11 and 12). The stop and locking wedges 90 and 92 cooperate with associated features formed on the interior surface of corresponding side walls 95 of the plug front section 30. As shown in FIGS. 13 and 14, the interior surfaces of the side walls 95 include an outer channel 120 and an inner cutout 93. The stop wedge 90 and locking wedge 92 engage the outer channel 120 and inner cutout 93 and surround a bridge 121 therebetween to prevent the plug TPA 18 from being entirely removed from the plug housing 28 once the plug TPA 18 is initially inserted. The stop wedge 90, once engaging the inner cutout 93, securely retains the plug TPA 18 in a final engaged position corresponding to a position at which the terminals are securely mated to cavity latches (explained below in more detail). The TPA arms 86 include outer fingers 98 that are tapered and received behind the cavity latches in the plug housing 28 only when the terminals are properly inserted into a mated position.

Figure 6:
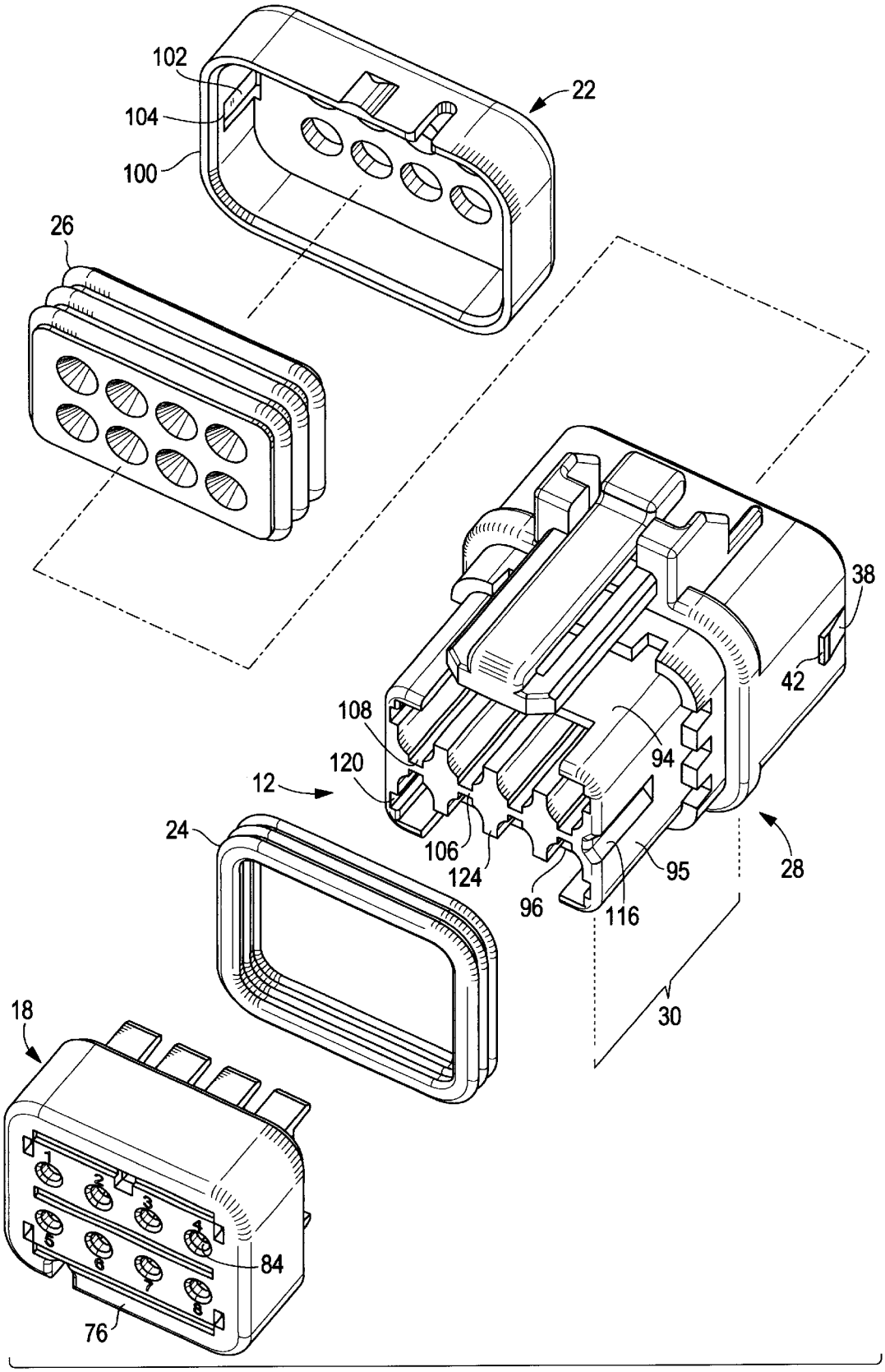
FIG. 6 illustrates an exploded isometric view from the mating end of the plug assembly in accordance with a preferred embodiment of the present invention.

FIG. 6 illustrates the plug assembly 10 aligned in an opposite direction with the mating end 12 facing forward. FIG. 6 illustrates in more detail the interior of the plug cover seal 22. At least one interior surface, such as on the side walls 100 of the plug cover seal 22, includes a cutout 102 formed to receive the latching projections 38. A rear wall 104 of the cutout 102 securely engages the shoulder 42 on the latching projection 38. With reference to the plug housing 28 of FIGS. 6, 13 and 15, the plug front section 30 includes a cross member 106 extending between the side walls 95. The cross member 106 includes a plurality of slots 108 cut in upper and lower surfaces of the cross member 106 and configured to align with the wire receiving openings 84 and 64 in the plug TPA 18 and plug cover seal 22. The slots 108 accept contacts connected to wires extending through the wire receiving openings 84 in the plug TPA 18. The slots 108 are separated by raised ridge sections 124 that separate the wires housed within the plug assembly 10.

Figure 9:
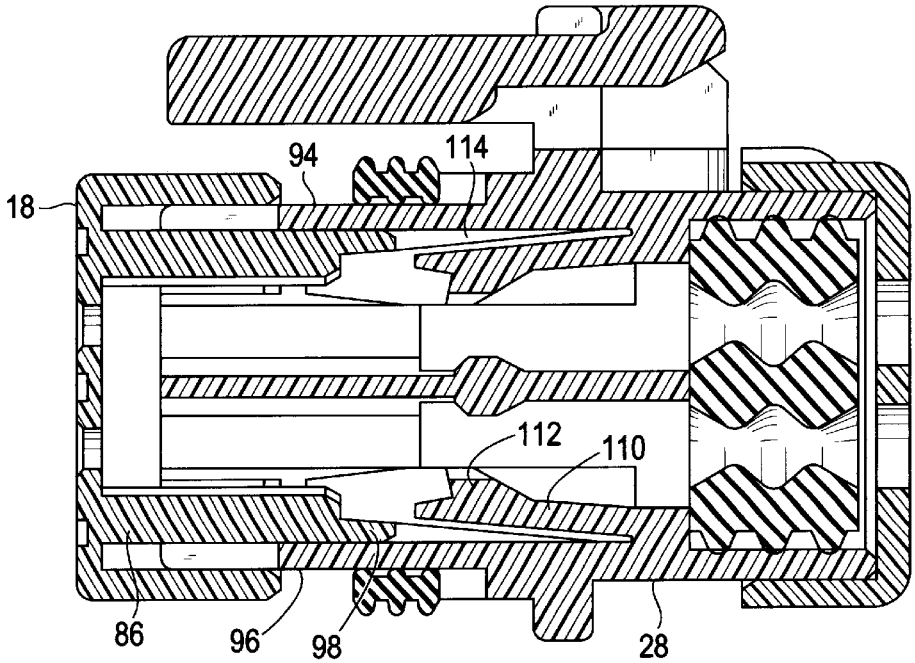
FIG. 9 illustrates a cross-sectional view of the plug assembly in accordance with a preferred embodiment of the present invention.
Figure 15:
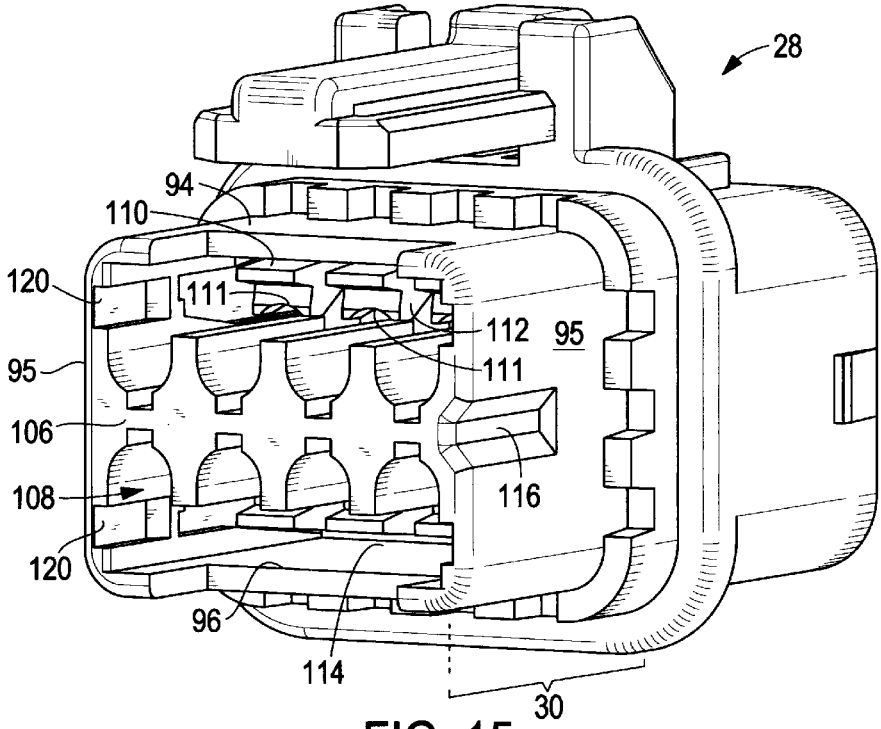
FIG. 15 illustrates an isometric view of a plug housing in accordance with a preferred embodiment of the present invention.

FIG. 9 illustrates a cross sectional view of the plug housing 28 taken along the line 9—9 in FIG. 1. As shown in FIGS. 9 and 15, the plug housing 28 includes a plurality of terminal latches 110 formed integrally with the interior surfaces of top and bottom walls 94 and 96 of the plug front section 30. The terminal latches 110 may be formed with an arcuate inner surface 111 (FIG. 15) extending in a direction parallel to the longitudinal axis of the plug housing 28. The arcuate surface 111 is contoured to receive the terminal wires inserted into the plug housing 28. Each terminal latch 110 includes a forked projection 112 directed inward and having the arcuate inner surface 111 shaped to grasp the contour of a terminal wire. The terminal latches 110 are deflectable from a non-engaged position to a bias position in which the terminal latches 110 engage the terminal wires. A latch cavity 114 is formed behind each terminal latch 110 and cooperates to receive a corresponding finger 98 on a TPA arm 86 when the plug TPA 18 is fully inserted to a terminal engaging position. Once the arms 98 are inserted into the latch cavities 114, the forked projections 112 on the terminal latches 110 securely engage the terminal wires and prevent the wires from being inadvertently pulled from the plug housing 28.

As shown in FIG. 15, at least one side wall 95 of the plug front section 30 includes a plug keying notch 116 extending from the front end 12 rearward along the outer surface of the side wall 95. The plug keying notch 116 cooperates with a projecting rail 118 (FIG. 11) extending along the interior surface of a corresponding side wall 82 of the plug TPA 18. The rail 118 and plug keying notch 116 cooperate to ensure proper orientation and alignment between the plug TPA 18 and the plug housing 28.

FIG. 15 illustrates that the inner surfaces of the side walls 95 of the plug front section 30 include outer channels 120 cut therein as discussed above. A bridge 121 behind the outer channel 120 cooperates with the stop and locking wedges 90 and 92 formed on the outer sides of the outer TPA arms 86. The bridges 121 include shoulders 122 having ramped inner and outer surfaces to engage the stop and locking wedges 90 and 92 in order to retain the plug TPA 18 in an initial terminal disengaged position (when the shoulders 122 are located between the stop and locking wedges 90 and 92), and a terminal engaged position (when the shoulders 122 are located behind the locking projections 92.

Figure 4:
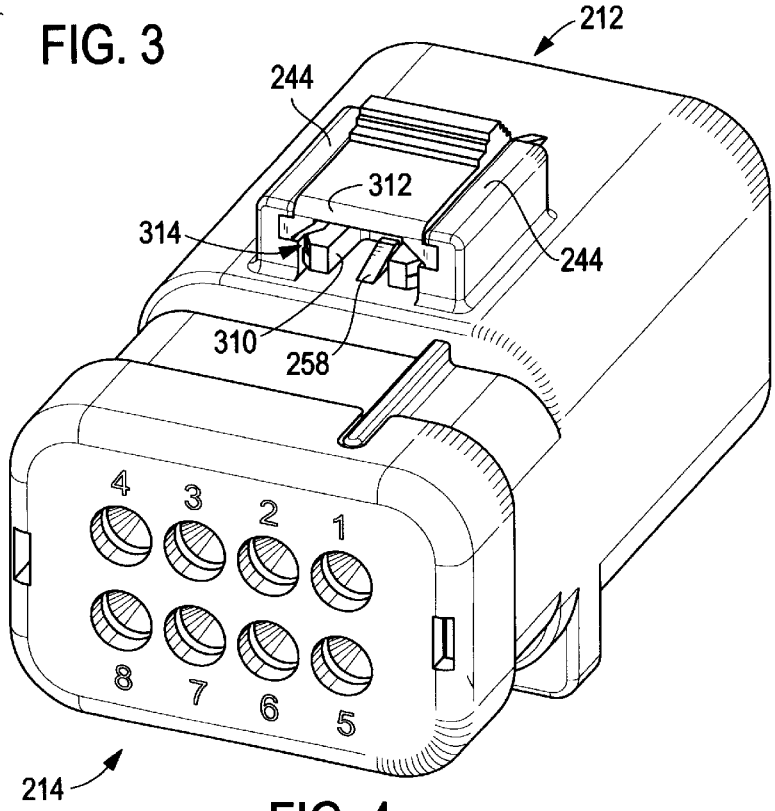
FIG. 4 illustrates an isometric view from a back end of the cap assembly in accordance with a preferred embodiment of the present invention.
Figure 7:
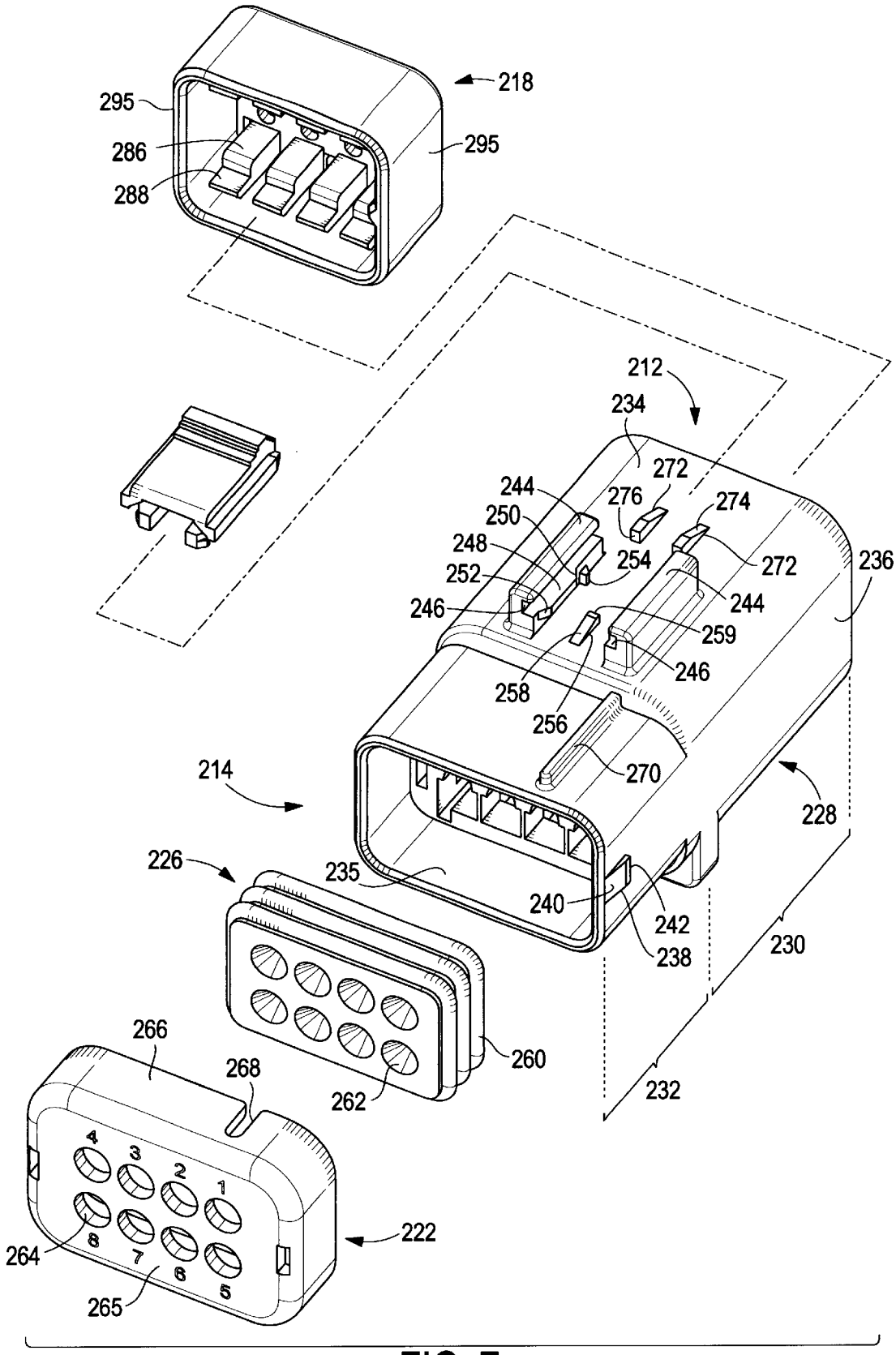
FIG. 7 illustrates an exploded isometric view from the back end of the cap assembly in accordance with a preferred embodiment of the present invention.
Figure 8:
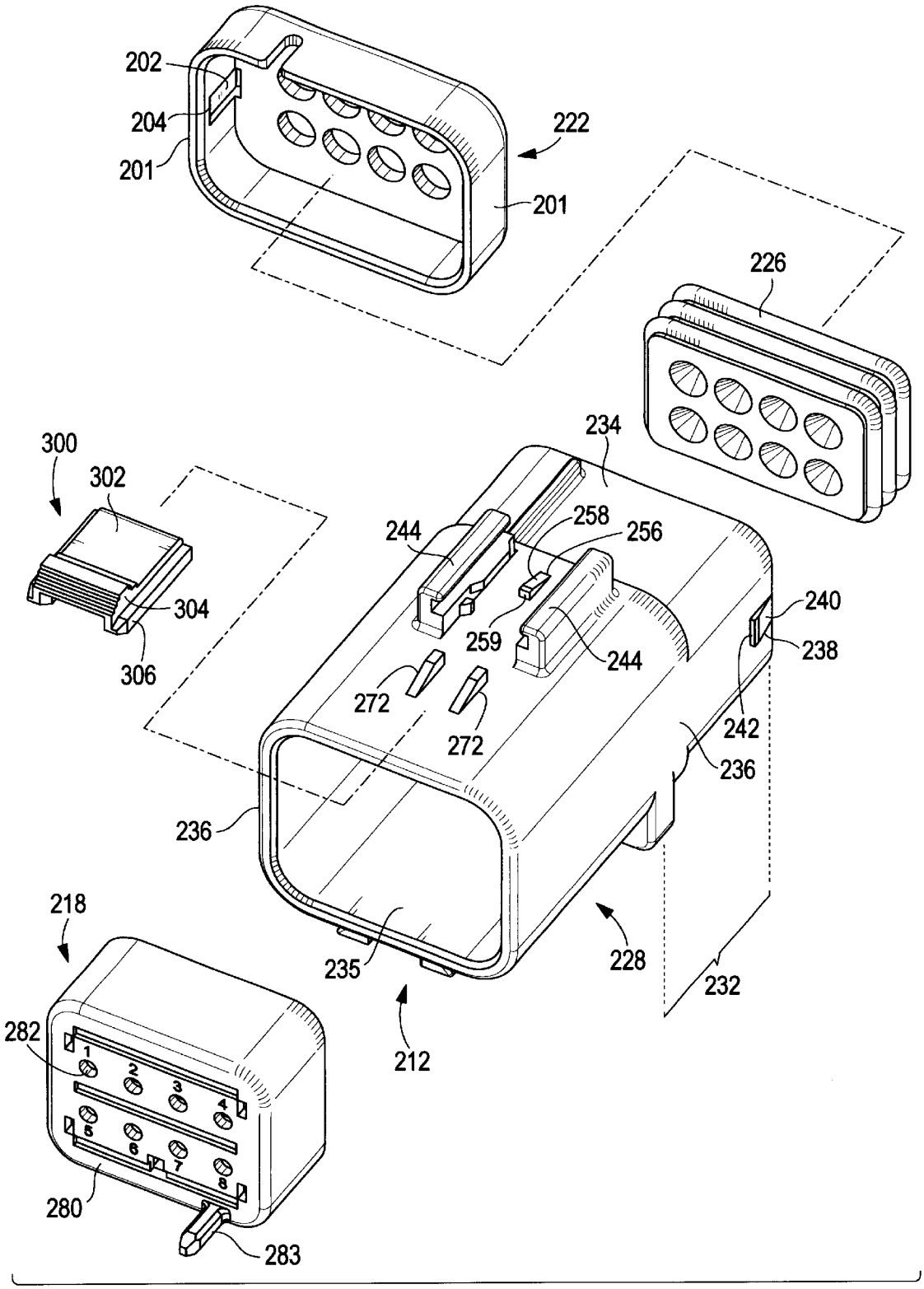
FIG. 8 illustrates an exploded isometric view from the mating end of the cap assembly in accordance with a preferred embodiment of the present invention.

Next, the cap assembly 200 will be described in more detail. As shown in FIGS. 3 and 4, the cap assembly 200 includes a front end 212 and a rear end 214. The front end 212 matingly receives the front end 12 of the plug assembly 10. As shown in FIGS. 7 and 8, the cap assembly 200 comprises a cap TPA 218, a cap wire seal 226 and a cap housing 228. The cap housing 228 includes top, bottom and side walls 234–236. The cap housing 228 includes a cap front section 230 and a cap rear section 232. The interior surfaces of the top, bottom and side walls 234–236 proximate the cap rear section 232 define a cavity adapted to receive the cap wire seal 226. The cap wire seal 226 includes a plurality of outer ribbed surfaces 260 that form a seal with the interior of the walls 234–236 on the cap housing 228. The cap wire seal 226 includes a plurality of wire receiving apertures 262 that align with wire receiving openings 264 in the face plate 265 on the cap cover seal 222.

Figure 16:
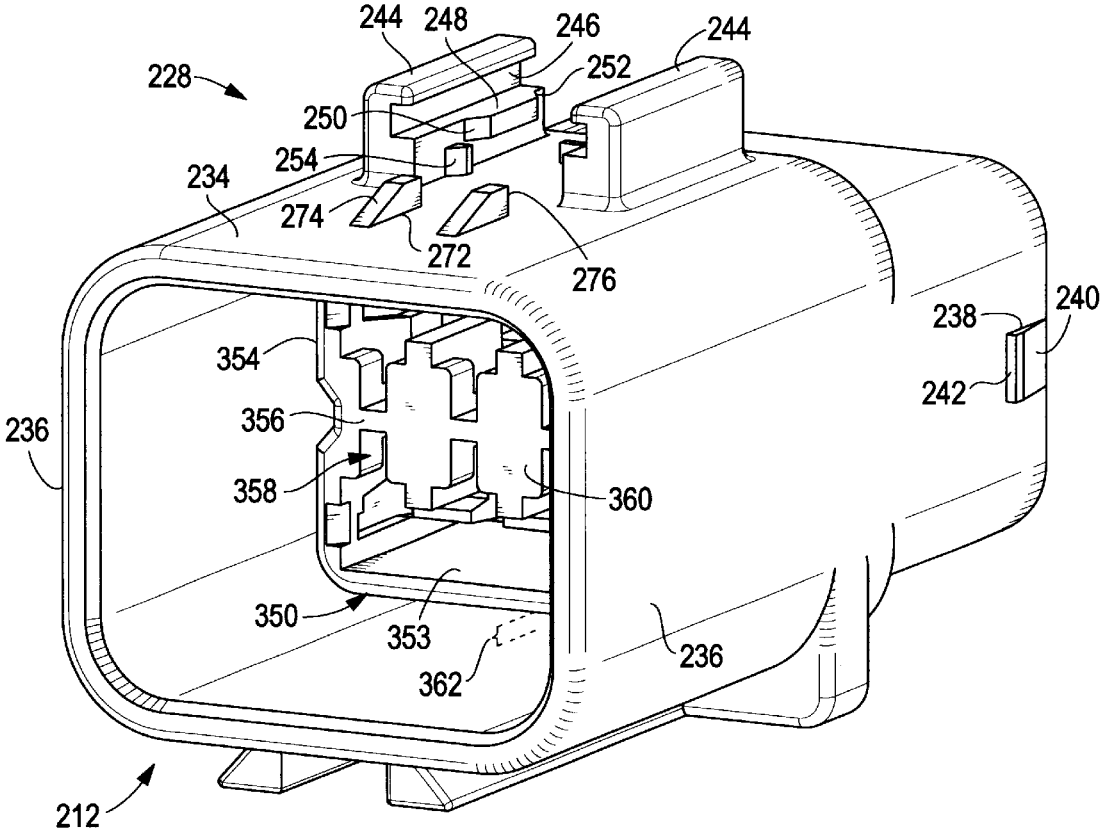
FIG. 16 illustrates an isometric view of a cap housing in accordance with preferred embodiment of the present invention.
Figure 17:
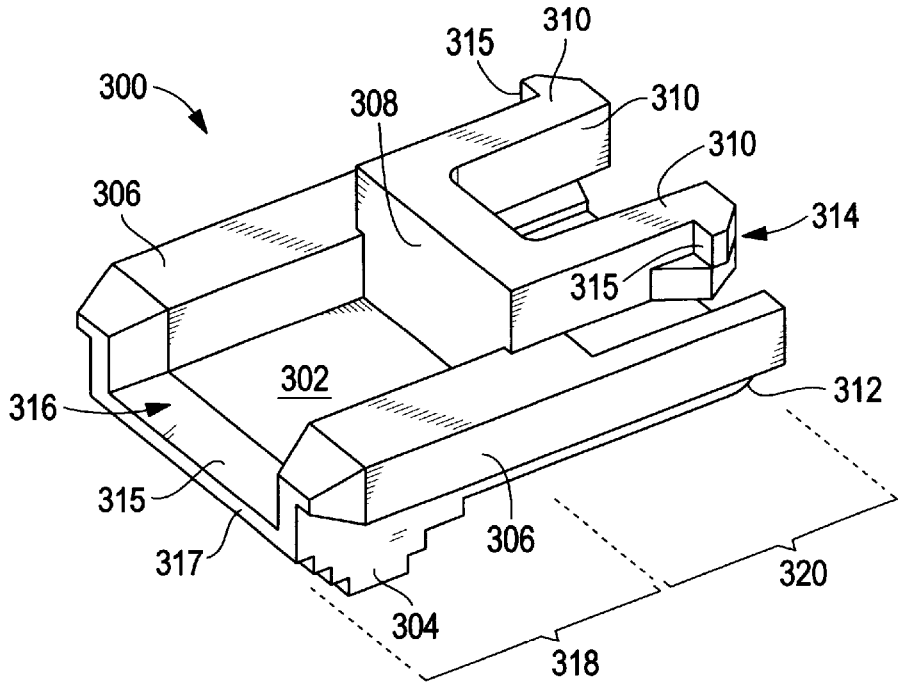
FIG. 17 illustrates the bottom of a connector position assurance device formed in accordance with a preferred embodiment of the present invention.
Figure 18:
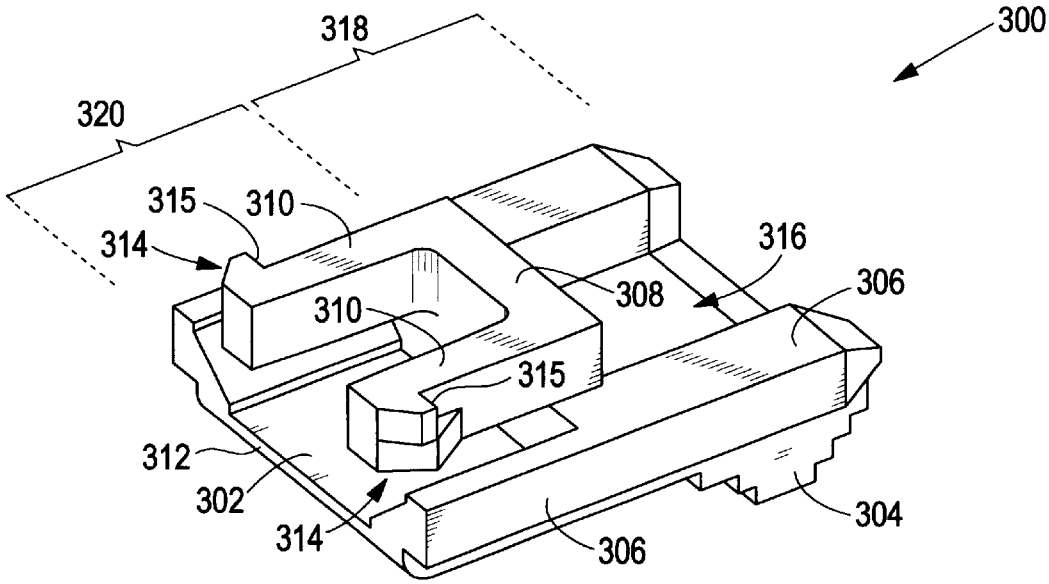
FIG. 18 illustrates a bottom isometric view of a CPA formed in accordance with a preferred embodiment of the present invention.

A top side 266 of the cap wire seal 222 includes a slot 268 that aligns with a rib 270 on the top wall 234 of the rear section 232 of the cap housing 228. The slot 268 and rib 270 cooperate to ensure proper orientation of the cap cover seal 222. As shown in FIGS. 7, 8 and 16, opposite side walls 236 on the cap housing 228 include latching projections 238 having ramped surfaces 240 and engaging shoulders 242. The latching projections 238 are received within cutouts 202 in the interior surfaces of side walls 201 of the cap cover seal 222. The cutouts 202 include rear walls 204 that engage the shoulders 242 on latching projections 238 to retain the cap cover seal 222 in an engaged position.

As shown in FIGS. 7, 8 and 16, the top wall 234 of the cap housing 228 includes a pair of guide rails 244 extending parallel to one another along a direction substantially perpendicular to a longitudinal axis of the cap housing 228. The guide rails 244 are located proximate opposite sides of the top wall 234. The guide rails 244 include guide ways 246 cut therein along opposed interior surfaces of the guide rails 244. The guide ways 246 extend along a length of the guide rails 244. At least one guide rail 244 includes a flared ledge 248 aligned with a bottom surface of the guide way 246. The ledge 248 includes ramped forward and rear edges 250 and 252 (FIG. 16). An interior side of the guide rail 244 further includes a projection 254 located forward of the flared ledge 248 and having a ramped surface and a stop edge.

The top wall 234 includes a CPA latch 256 (FIG. 8) having a ramped surface 258 and a locking edge 259. The CPA latch 256 is oriented with the ramped surface 258 directed toward the rear end 214 of the cap assembly 200 and with the locking edge 259 facing toward the front end 212 of the cap assembly 200. The top wall 234 further includes a pair of latching projections 272 spaced apart from one another and directed toward the rear end 214 of the cap assembly 200. The latching projections 272 include ramped surfaces 274 (FIG. 16) directed toward the front end 212 and stop edges 276 directed toward the rear end 214.

FIGS. 3–4, 7–8 and 17–18, further illustrate a connector position assurance device (CPA) 300 having a rectangular shaped base 302 with a raised portion 304 extending along one end of the base 302. The raised portion 304 includes ramped surfaces extending along either side thereof and including ridges to afford better engagement by a user when the user moves the CPA 300 between engaged and disengaged positions. The CPA 300 further includes a pair of flanges 306 extending along either side thereof and directed outward from the base 302. Optionally, the base 302, raised portion 304 and flanges 306 may be formed integral with one another. The flanges 306 are configured to be received within the guide ways 246 in the guide rails 244. The guide ways 246 and flanges 306 cooperate to permit the CPA 300 to slide relative to the cap housing 228 between engaged and disengaged positions.

When in a disengaged position, the CPA 300 is retained upon the cap housing 228 separate and apart from the plug housing 28. A bottom surface of the CPA base 302 includes a cross-bar 308 extending downward from the base 302 and formed integrally with the base 302. The cross bar 308 may be located at an intermediate point along the length of the base 302 and aligned to extend across a width of the base 302. The cross bar 308 includes a pair of latching beams 310 projecting forward therefrom toward the rear edge 312 of the base 302. Outer ends of the latching beams 310 include projections 314 extending outward therefrom and having ramped leading edge surfaces and latching rear surfaces 315. The latching rear surfaces 315 on projections 314 engage the notched rear edges 252 of the flared ledge 248 to secure the CPA 300 in an engaged position. While in the engaged position, the cross bar 308 on the CPA 300 abuts against the locking edge 259 on the CPA latch 256 to prevent the CPA from being removed from the guide rails 244.

As illustrated in FIGS. 3 and 4, the CPA 300 is inserted into the guide rails 244 from the rear end 214 in a direction denoted by arrow A. As the CPA 300 is inserted into the guide rails 244, the cross bar 308 rides over the ramped surface 258 on the CPA latch 256 until the backside of the cross bar 308 engages the locking edge 259 of the CPA latch 256 (see FIG. 4). FIGS. 3 and 4 illustrate the CPA 300 while in its initial disengaged position, yet retained on the cap assembly 200. As illustrated in FIGS. 3 and 4, both flanges 306 of the CPA 300 are substantially enclosed by the guide rails 244. When the cap assembly 200 and the plug assembly 10 are mated in a final position, the CPA 300 is moved further in the direction indicated by arrow A to a final engaged position, at which the CPA 300 engages the latch member 16. When in the final position, the CPA 300 is moved in a direction indicated by arrow A substantially parallel to the longitudinal axis of the cap assembly 200 to a position at which portions of the flanges 306 of the CPA 300 are exposed from and project out of the guide rails 244. Extending the CPA 300 until the flanges project beyond the edges of the guide rails 244 when in an engaged position enables easier visual confirmation that the CPA 300 is in its final engaged position and that the plug assembly 10 and cap assembly 200 are properly mated.

Figure 19:
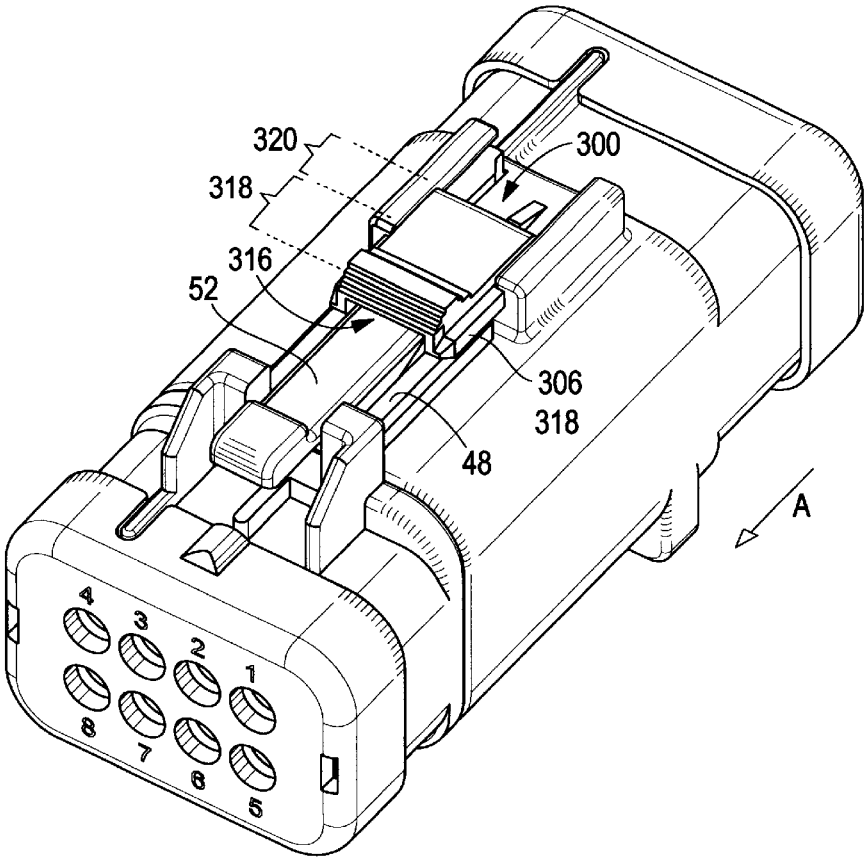
FIG. 19 illustrates an isometric view of plug and cap assemblies joined in a fully mated and locked manner in accordance with a preferred embodiment of the present invention.

As the CPA 300 moves to its final engaged position (FIGS. 18 and 19), the latching beams 310 are biased inward toward one another to permit the projections 314 (FIG. 4) to move inward to ride over the rear edges 252 on the flared ledges 248 (FIG. 16). The latching beams 310 ride along the flared ledges 248 until the projections 314 clear the flared ledges 248 and the rear edges on projections 314 engage the forward edges on the flared ledges 248. The projections 254 engage the front surfaces of the projections 314 to prevent the CPA 300 from moving to far forward in the direction of arrow A.

During a latching operation, the plug assembly 10 and cap assembly 200 are aligned such that the front end 12 and plug TPA 18 are received within the opening in the front end 212 of the cap assembly 200. The plug assembly 10 is forced into the cap assembly 200 until the outer end of the latching member 16 engages the latching projections 272. As the plug assembly 10 is further inserted, the cross bar 50 on the latching member 16 is biased upward and slid along the ramped surfaces 274, thereby biasing the support rods 48 and latch beam 52 upward. The cross bar 50 is moved over the latching projections 272 until the inner surface of the cross bar 50 engages the stop edges 276. Hence the latching projections 272 are retained under the latch beam 52 against the cross bar 50, while the support rods 48 lie directly against the top wall 234 of the cap housing 228.

Figure 20:
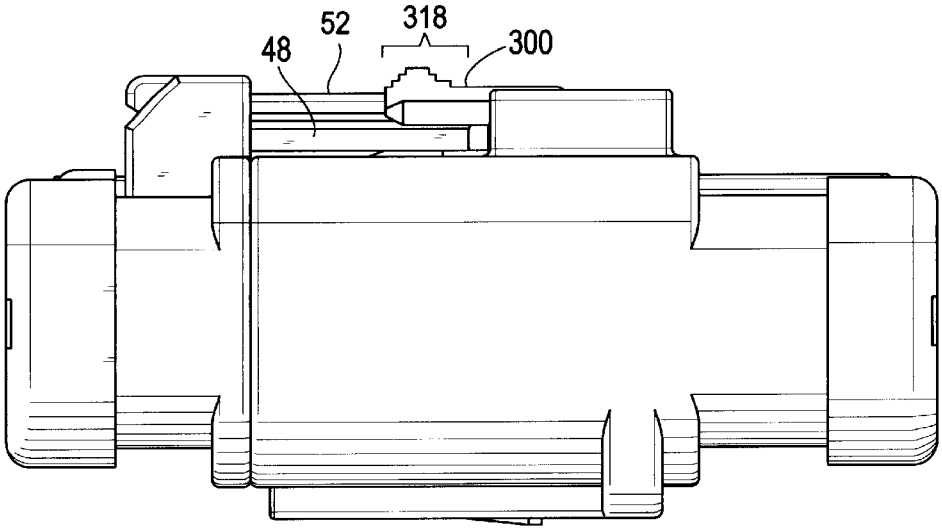
FIG. 20 illustrates a side view of a plug and cap assembly joined in a fully mated and locked position in accordance with a preferred embodiment of a present invention.

Once the cross bar 50 snaps over the latching projections 272 (FIGS. 19 and 20), the support rods 48 and latch beam 52 are deflected into a position substantially in line with the channel 316 extending along the bottom of the base 302 and between the flanges 306. The width of the channel 316 corresponds to the width of the latch beam 52. Hence, when the CPA 300 is moved in the direction of arrow A to the engaged position (at which the CPA 300 partially extends beyond the ends of the guide rails 244), the flanges 306 run along the top surfaces of the support rods 48 and the channel 316 receives the outer portion of the latch beam 52. Front end portion 318 of the channel 316 and flanges 306 engage and retain the outer end of the support rods 48 and latch beam 52 downward against the top wall 234 of the cap housing 228. Rear portion 320 (FIG. 19) of the flanges 306 remain within the guide rails 244, thereby preventing the CPA 300 from being deflected upward away from the top wall 234 of the cap housing 228.

The channel 316 and flanges 306 are configured such that the CPA 300 is unable to move to its engaged position during assembly of a plug assembly 10 and cap assembly 200, unless and until the latching member 16 is received over the latch projections 272. The post 54 on the rear end of the latch beam 52 enables the latch member 16 to be disconnected from the cap assembly 200. To disconnect the latch member 16, the post 54 is pressed downward, thereby prying the support rods 48 upward and the cross bar 50 upward over the latching projections 272.

The CPA 300 is configured to permit the plug assembly 10 to be inserted into the cap assembly 200 even when the CPA 300 is prematurely moved to its final engaged position. The base 302 includes a chamfered edge 315 along the front edge 317 below the raised portion 304 to guide the latch beam 52 into the channel 316. When the CPA 300 is prematurely moved to its final latching position, the cross bar 50 engages the chamfered edge 315 and is guided into the channel 316. As the latch member 16 is moved to its latched position and is deflected upward over the latching projections 272, the front end portion 318 of the CPA 300 is deflected slightly upward. The flanges 306 fit in the guide rails 244 with a slight tolerance to permit the front end 318 of the CPA 300 to be deflected upward as the latching member 16 is moved to its engaged position. Once in the engaged position, the latch member 16 is deflected downward and the biasing force applied by the guide rails 244 to the CPA 300 biases the front end portion 318 of the CPA 300 downward as well.

With reference to FIG. 8, the cap TPA 218 includes a front plate 280 with a plurality of wire receiving openings 282 therein. The front plate 280 further includes a keying post 283 extending outward from the cap TPA 218. The keying post 283 aligns with a keying opening 83 (FIG. 1) in the plug TPA 18. The keying post 283 and keying opening 83 cooperate to ensure proper orientation of the plug and cap assemblies 10 and 200. Optionally, different keying post and opening combinations 283 and 83 may be used with different types of plugs and caps to ensure that, in an application including multiple plugs and caps located in a common area of a system, each plug is connected to the correct associated cap. By providing the keying feature offered by post 283 and opening 83 on the cap TPA 218 and plug TPA 18, keying feature capabilities are afforded without enlarging the overall envelope of the plug and cap assemblies 10 and 200 which might otherwise be increased if keying features were provided around the perimeter of the plug assembly 10 and/or cap assembly 200.

As illustrated in FIG. 7, the cap TPA 218 includes a plurality of TPA arms 286 formed on the interior surface of the front plate 280. Each TPA arm 286 includes a finger 288 extending outward therefrom. Optionally, the TPA arms 286 located nearest the side walls 295 may include stop wedges and locking wedges (not illustrated) similar to those described above in connection with the plug TPA 18. The stop wedges and locking wedges on TPA arms 286 engage similar structures formed on the interior of the cap housing 228 to retain the cap TPA 218 in an initial position and then in an engaged position.

Figure 10:
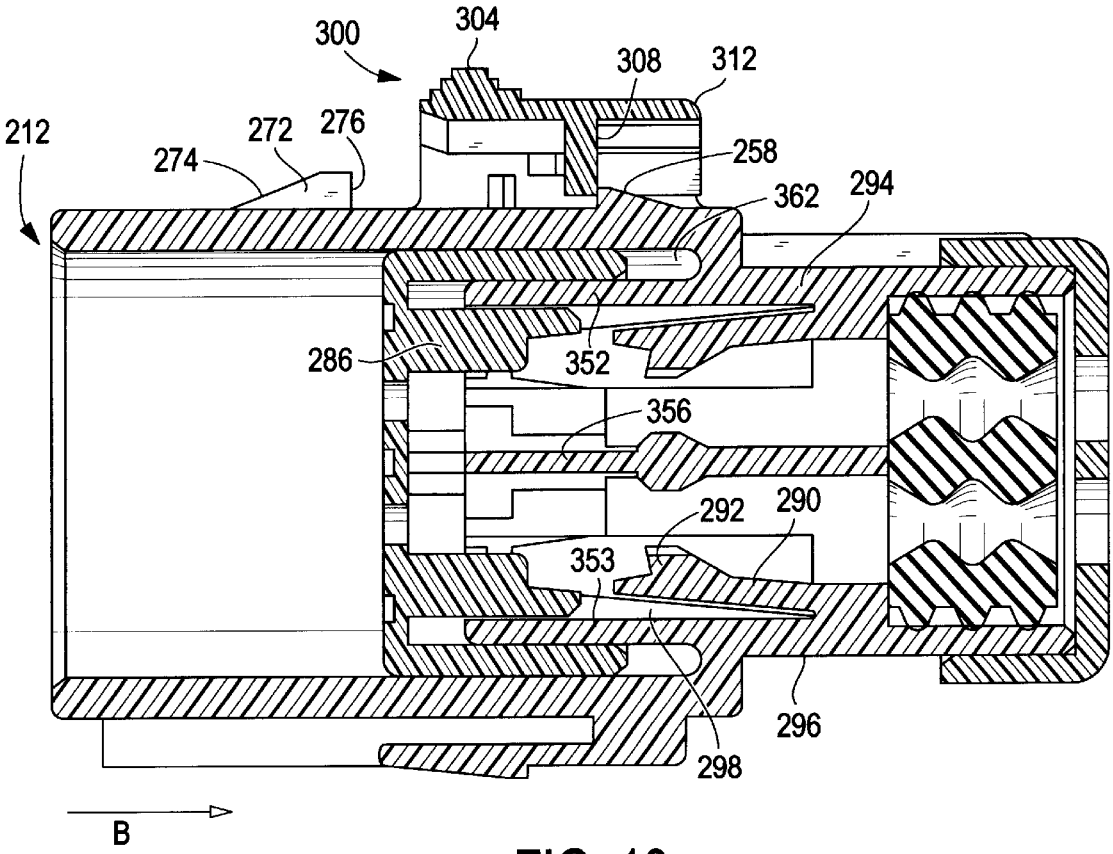
FIG. 10 illustrates a cross-sectional view of the cap assembly in accordance with a preferred embodiment of the present invention.

FIG. 10 illustrates a cross sectional view taken along line 10—10 in FIG. 3. The top and bottom walls 294 and 296 on the TPA housing 228 include terminal latches 290 formed integrally therewith and extending inward at an angle toward the front end 212. The terminal latches 290 resemble terminal latches 110 discussed above. The terminal latches 290 include forked projections 292 on the outer ends thereof and have arcuate shaped cutouts therein to receive the terminal wires. Latch cavities 298 are provided between the terminal latches and the top and bottom walls 294 and 296.

As shown in FIG. 16, the cap assembly 200 includes an interior shell 350 formed integrally with the cap housing 228. The interior shell 350 is configured substantially similar to the plug front section 30 discussed above in connection with FIG. 15. In particular, the interior shell 350 includes top, bottom and side walls 352–354. The side walls 354 are connected through a cross member 356. The cross member 356 includes a plurality of slots 358 configured to receive the terminal wires. The slots 358 are separated with ridged sections 360. The slots 358 open upward and downward from the cross member 356.

Once the terminal wires are inserted into the cap housing 228, the cap TPA 218 is inserted through the front end 212 until the top, bottom and side walls of the cap CPA 218 are received within an outer groove 362 surrounding the interior shell 350. The cap TPA is further inserted in the direction of arrow B (FIG. 10) until the fingers 288 on the TPA arms 286 are securely received within the latch cavities 298 and bias the terminal latches 290 inward against the terminal wires.

Optionally, the latch member 16, CPA 300 and associated features and structure may be provided on the bottom or sides of the plug assembly 10 and cap assembly 200, respectively.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An electrical connector housing assembly that includes a connector position assurance device (CPA) comprising:

a CPA;

a plug housing having top, bottom and side walls defining a mating interface;

a cap housing having top, bottom and side walls defining an opening receiving said mating interface of said plug housing;

a deflectable latch beam located on said plug housing;

at least one latch mating element formed on said cap housing, said latch mating element positioned to securely engage said latch beam when said cap and plug housings are fully mated with one another; and a CPA retainer formed on said cap housing, said CPA retainer slidably receiving and holding said CPA in an initial position when said plug housing and cap housing are separated from one another and in a final position when said plug housing and cap housing are fully mated, said CPA engaging and retaining said latch beam in an engaged relation with said at least one latch mating element when said CPA is located in its final position.

2. The connector housing assembly of claim 1, wherein said CPA retainer includes:

a pair of guide rails aligned parallel to one another and mounted on a top wall of said cap housing, said guide rails including juxtaposed channels cut therein defining a guide way slidably receiving said CPA.

3. The connector housing assembly of claim 1, wherein said cap housing further includes a latching shoulder on one of said top and side walls, said latching shoulder aligning with and engaging said latch beam when said plug and cap housings are fully mated.

4. The connector housing assembly of claim 1, said CPA retainer including channels slidably receiving said CPA, said CPA moving between an initial unmated position in said channels to a final mated position in said channels only after said plug and cap housings are fully mated.

5. The connector housing assembly of claim 1, said CPA retainer supporting said CPA in a first position relative to said latch mating element on said plug housing when said plug and cap housings are disengaged and in a second position relative to said latch mating element when said plug and cap housings are fully engaged.

6. The connector housing assembly of claim 1, wherein said CPA includes a base with deflectable beams thereon, said deflectable beams engaging said CPA retainer to hold said CPA on said cap housing when said plug and cap housings are disengaged.

7. The connector housing assembly of claim 1, further comprising:

contact receiving cavities in said plug and cap housing; and plug and cap terminal position assurance devices (TPAs) mounted in said contact receiving cavities, respectively, said plug and cap TPAs having keying features thereon configured to join one another to ensure proper orientation and alignment of said plug and cap housings.

8. The connector housing assembly of claim 1, wherein said CPA retainer comprise:

a guide way slidably receiving said CPA, said guide way defining a range of motion through which the CPA moves, said CPA retainer initially holding said CPA on said cap housing in a prestaging position along said guide way before said plug and cap housings are mated, said CPA being movable in said CPA retainer through said guide way along said range of motion from said prestaging position to a final position at which said CPA securely engages said latch beam after said plug and cap housings are fully mated.

9. The connector housing assembly of claim 1, wherein said deflectable latch comprise:

a pair of latch rods formed integrally with said plug housing and extending toward a cap mating end of said plug; and a cross bar formed on an outer end of said latch rods to snappably engage said latch mating element when said plug and cap housings are fully mated.

10. An electrical connector assembly comprising:

a plug having a rear end receiving plug wires and a cap mating end having plug terminals electrically communicating with said plug wires;

a cap having a rear end receiving cap wires and a plug mating end having a cavity to receive said cap mating end of said plug, said cavity including cap terminals electrically communicating with said cap wires, said cap terminals aligning with said plug terminals to form an electrical connection therebetween when the plug and cap are fully mated with one another;

a latch member mounted on a wall of said plug and extending in a direction between said cap mating and rear ends of said plug, said latch member being biased toward said plug and deflectable outward away from said plug;

at least one latch projection located on said cap and aligned to securely engage said latch member when said plug and cap are fully mated; and a CPA and CPA retaining member located on said cap, said CPA retaining member having a guide way slidably receiving said CPA, said guide way defining a range of motion through which said CPA moves, said CPA retaining member initially holding said CPA on said cap in a prestaging position in said guide way before said plug and cap are mated, said CPA being movable in said CPA retaining member through said guide way along said range of motion from said prestaging position to a final position at which said CPA securely engages said latch member after said plug and cap are fully mated.

11. The electrical connector assembly of claim 10, wherein said latch member further comprises:

at least one vertical support formed on a top wall of said cap housing; and at least one support rod formed on said vertical support and extending along a surface of said top wall, said support rod having a rod outer end opposite said vertical support, said rod outer end including a latch engaging face configured to snappably engage said latch projection on said cap.

12. The electrical connector assembly of claim 10, wherein said latch member further comprises:

a beam configuration having a rear end secured to a wall of said cap and a free standing front end biased toward said cap to engage said latch projection when said plug and cap are mated, said beam configuration including a release arm secured to said front end and projecting toward said rear end, said release arm having an actuating end remote from said front end, said release arm deflecting said front end of said beam configuration in a deflection direction away from said latch projection to disengage said plug when said actuating end of said release arm is pressed in a direction toward said plug.

13. The electrical connector assembly of claim 10, wherein said latch member further comprises:

a pair of latch rods formed integrally with said plug and extending toward said cap mating end of said plug; and a cross bar formed on an outer end of said latch rods to snappably engage said latch projection when said plug and cap are fully mated.

14. The electrical connector assembly of claim 10, further comprising:

a plug seal cover mounted on said rear end of said plug; and a plug wire seal mounted between said plug seal cover and rear end of said plug, said plug seal cover including a keying notch in a side thereof, said plug including a keying ridge formed on a wall of said plug, said keying ridge fitting in said keying notch, said plug seal cover fitting on said plug only when said keying notch and keying ridge are aligned with one another.

15. The electrical connector assembly of claim 10, wherein said CPA retaining member further comprises:

a pair of guide rails extending parallel with one another and having inner surfaces with channels cut therein and aligned to face one another, said CPA including flanges on either side thereof slidably received in said channels, said CPA sliding along said channels between said prestaging position and said final position.

16. The electrical connector assembly of claim 10, wherein said CPA retaining member further comprises:

a CPA retaining projection on a wall of said cap, said CPA retaining projection including a stop edge engaging a side of said CPA when said CPA is in said prestaging position to prevent removal of said CPA from said cap.

17. The electrical connector assembly of claim 10, wherein said CPA comprises:

a base having a front, a rear and sides, said sides including flanges that slidably engage said CPA retaining member, said flanges and base residing substantially within said CPA retaining member when in said prestaging position, said base and flanges projecting partially beyond a front edge of said CPA retaining member when in said final position.

18. The electrical connector assembly of claim 10, wherein said CPA retaining member is located on a first section of said cap and said latch projections are located on a second section of said cap, said first and second sections not overlapping, said CPA moving to a position partially bridging said first and second sections when in said final position to afford visual indication of a fully mated connection between said plug and cap.

19. An electrical connector housing assembly that includes a connector position assurance device (CPA) comprising:

a CPA;

a plug housing having top, bottom and side walls and having plug front and rear ends;

a cap housing having top, bottom and side walls and having cap front and rear ends, said plug and cap front ends mating with one another;

a deflectable support rod having a rear end secured to said plug housing proximate said plug rear end having a free standing outer end proximate said plug front end, said outer end including a latch, said outer end and said latch being deflectable toward and away from said plug housing;

at least one latch mating element on said cap housing, said latch on said outer end of said support rod snappably engaging said at least one latch mating element when said cap and plug housings are fully mated with another; and a CPA retainer formed on said cap housing, said CPA retainer slidably receiving said CPA, said CPA being movable relative to said CPA retainer between an initial position at which said plug housing and cap housing are separated from one another and a final position at which said plug housing and cap housing are fully mated, when in said final position, said CPA engaging and retaining said outer end of said support rod to hold said support rod in an engaged relation with said at least one latch mating element.

20. The connector housing assembly of claim 19, wherein said support rod further comprises a pair of support rods extending parallel to one another and having a cross bar joining free standing outer ends thereof, said cross bar forming said latch.

21. The connector housing assembly of claim 19, wherein said at least one latch mating element includes a pair of latching projections extending upward from said top wall of said cap housing.

22. The connector housing assembly of claim 19, wherein said CPA includes a pair of flanges on opposite sides thereof, said flanges being slidably received in said CPA retainer, said flanges being spaced apart by a channel that engages and retains said outer end of said support rod when said CPA, cap housing and plug housing are in said final position.

23. The connector housing assembly of claim 1, wherein said CPA includes a pair of flanges on opposite sides thereof, said flanges being slidably received in said CPA retainer, said flanges being separated by a channel that engages and retains an outer end of said deflectable latch when said CPA, cap housing and plug housing are in said final position.

24. The connector housing assembly of claim 10, wherein said CPA includes a pair of flanges on opposite sides thereof, said flanges being slidably received in said CPA retaining member, said flanges being separated by a channel that engages and retains an outer end of said deflectable latch when said CPA, cap and plug are in said final position.

25. The connector housing assembly of claim 1, wherein said CPA has front and rear end portions, said CPA retainer enclosing said front and rear end portions of said CPA when said CPA is in said initial position, said front portion of said CPA being exposed from and projecting out of said CPA retainer when said CPA is in said final position.

26. The connector housing assembly of claim 10, wherein said CPA has front a n d rear end portions, said CPA retaining member enclosing said front and rear end portions of said CPA when said CPA is in said initial position, said front portion of said CPA being exposed from and projecting out of said CPA retaining member when said CPA is in said final position.

* * * * *